United States Patent [19]

Miyazaki et al.

[11] Patent Number: 4,705,225

[45] Date of Patent: Nov. 10, 1987

[54] AUTOMATIC WRAPPING MATERIAL CHANGE-OVER APPARATUS

[75] Inventors: Masaru Miyazaki; Toshihide Kohata, both of Tokyo, Japan

[73] Assignee: Japan Tobacco, Inc., Japan

[21] Appl. No.: 833,581

[22] Filed: Feb. 26, 1986

[30] Foreign Application Priority Data

Mar. 29, 1985 [JP] Japan ..... 60-063229
Mar. 29, 1985 [JP] Japan ..... 60-045135[U]

[51] Int. Cl.[4] ..... B65H 19/20; B65H 19/26

[52] U.S. Cl. ..... 242/56 R; 83/304; 83/650; 83/74

[58] Field of Search ..... 242/56 R, 80, 58.1–58.4, 242/58; 156/502, 504–506, 361; 83/304, 305, 650, 74, 367; 226/29–31

[56] References Cited

U.S. PATENT DOCUMENTS 3,089,661 5/1963 Phillips et al. ..... 156/504 X
3,925,131 12/1975 Krause ..... 242/58.3 X
3,983,774 10/1976 Seragnoli ..... 83/650
4,159,661 7/1979 Russell et al. ..... 83/305
4,181,847 1/1980 Buschmann et al. ..... 226/30 X
4,346,853 8/1982 Stefanoni et al. ..... 242/58.1
4,361,260 11/1982 Hanlan ..... 226/30
4,534,253 8/1985 Seragnoli ..... 83/367 X

*Primary Examiner*—John M. Jillions
*Attorney, Agent, or Firm*—Lowe, Price, LeBlanc, Becker & Shur

[57] ABSTRACT

An automatic wrapping material change-over apparatus having a plurality of bobbins each with a wrapping material wound thereon and functioning to change-over from one bobbin from which the wrapping material is being drawn out, to another bobbin and cut simultaneously the wrapping material from the one bobbin and that from the another bobbin upon detection of a mark register between both wrapping materials, in which the thus-cut end of the wrapping material from the another bobbin follows the thus-cut end of the wrapping material from the one bobbin.

16 Claims, 16 Drawing Figures

AUTOMATIC WRAPPING MATERIAL CHANGE-OVER APPARATUS

BACKGROUND OF THE INVENTION

The present invention relates to an automatic wrapping material change-over apparatus and more particularly to an apparatus for changing over from a wrapping material being delivered from one bobbin to a wrapping material on the other bobbin in a wrapping material feeding system which draws out a wrapping material from a bobbin on which the wrapping material is wound, then cuts it into a predetermined size and then transfers it to a wrapping-machine.

An apparatus for this type is disclosed in Japanese Patent Laid-Open Publication No. 76696/1974, for example, in which when a wrapping material being drawn out from one bobbin is cut with a knife provided between said one bobbin and a main cutter knife, switching to the other bobbin occurs so that a leading end of the wrapping material from the other bobbin follows a cut end (trailing end) of the wrapping material drawn out from the one bobbin.

However, there is a time delay from the time when the other bobbin begins to rotate for change-over at a predetermined speed until the time when a force end of the wrapping material of said other bobbin begins to follow a cut end of the wrapping material drawn out from said one bobbin. Such a time delay can cause a timing error in the change-over.

Therefore, in the case where such an apparatus is applied to a wrapping material feeding system which cuts a wrapping material with patterns such as a tobacco wrapper into a predetermined size and then supplies it to a wrapping machine, there has been the problem that the pattern becomes out of register at the time of change-over and a defective product results.

In the conventional change-over apparatus, moreover, a change-over knife for cutting wrapping materials on one and the other bobbin at the time of change-over has been another problem.

More particularly, it is necessary that the change-over knife perform its cutting operation in conformity with the timing of a knife of the wrapping material feeding system. In the event of a timing error, wrapping materials having different cut sizes are sent to the wrapping machine at the time of the change-over. However, a conventional cutter knife is constructed so that at the time of cutting operation a knife roller rotates to a knife receiving roller side to cut a material moving therebetween. In this case, there occurs a slight time lag during rotation of the knife roller, so when such a change-over knife is applied to the above change-over apparatus, it is difficult to take timing with the knife of the wrapping material feed system.

SUMMARY OF THE INVENTION

The present invention solves the above-mentioned problems. It is a first object of the present invention to provide an automatic wrapping material change-over apparatus which does not cause a timing error at the time of change-over.

It is a second object of the present invention to provide an automatic wrapping material change-over apparatus applicable also to a wrapping material feed system which cuts a wrapping material with pattern into a predetermined size while registering the pattern and then supplies the cut material to a wrapping machine.

It is a third object of the present invention to provide an automatic wrapping material change-over apparatus provided with a cutting device capable of synchronized timing with another member.

The above objects of the present invention are attained by an automatic wrapping material change-over apparatus comprising first and second bobbins wound respectively with first and second wrapping materials, said first and second bobbins arranged opposite each other; feed roller means for drawing out said first wrapping material from the first bobbin; first and second bobbins and said feed roller means symmetrically with respect to the drawn out first wrapping material, said second wrapping material being adapted to be taken up onto the second take-up roller means; and change-over knife means provided upstream of each of said first and second take-up roller means at a predetermined distance therefrom for simultaneously cutting said first and second wrapping materials to produce a free wrapping material cut from said first wrapping material and a discard leading portion from said second wrapping material taken up on the take-up roller means.

BRIEF DESCRIPTION OF THE DRAWINGS

FIGS. 1 to 7 illustrate a first embodiment of the present invention, of which:

FIG. 1 is a schematic view of the whole of a wrapping material feed system equipped with an automatic wrapping material change-over apparatus according to the present invention;

FIG. 2 illustrates a power transfer route thereof;

FIG. 3 is a front view showing details of the automatic change-over apparatus;

FIG. 4 is a partial sectional view showing an SR clutch;

FIG. 6 is a flowchart showing a change-over operation routine, and

FIG. 7 is a flowchart showing a pattern registering routine.

FIGS. 8 and 9 illustrate a second embodiment of the present invention, of which:

FIG. 8 is a schematic view similar to FIG. 1, and

FIG. 9 illustates a power transfer route of the system shown in FIG. 8.

DESCRIPTION OF PREFERRED EMBODIMENTS

Embodiments of the present invention will be described hereinunder with reference to the drawings.

Figure 1:
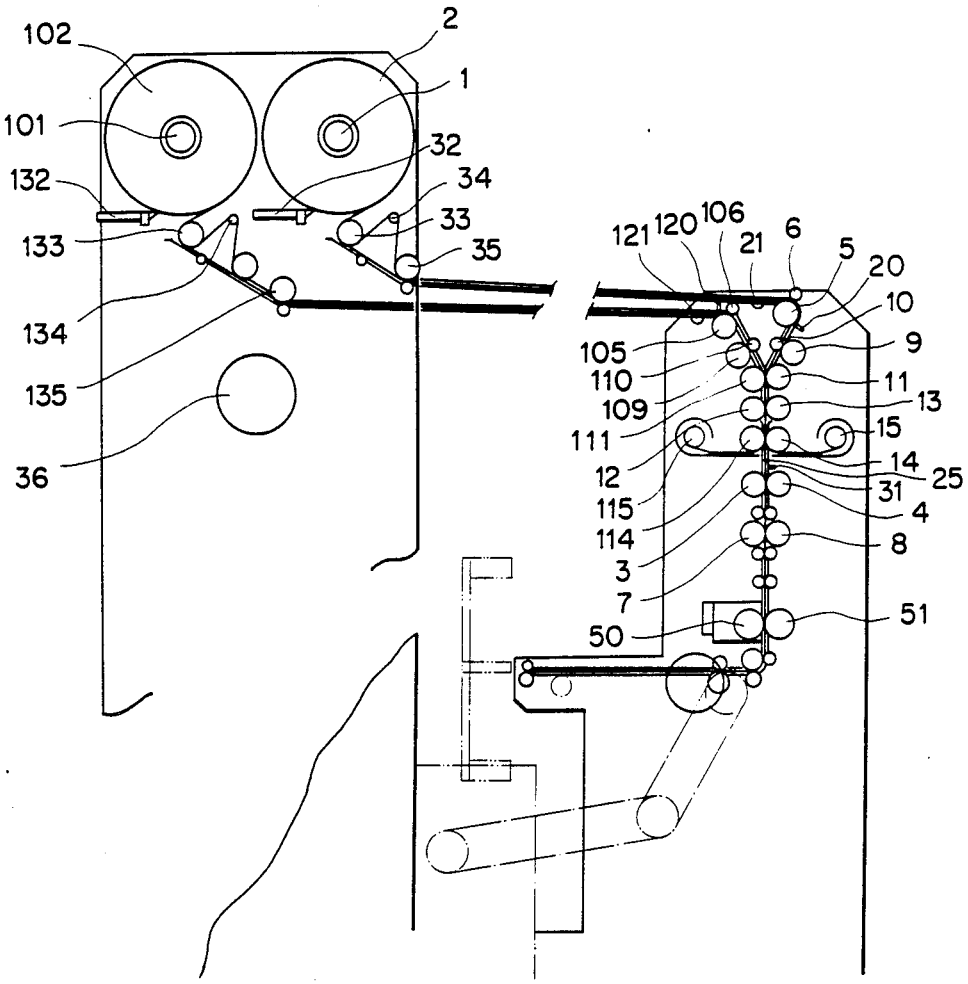
Figure 2:
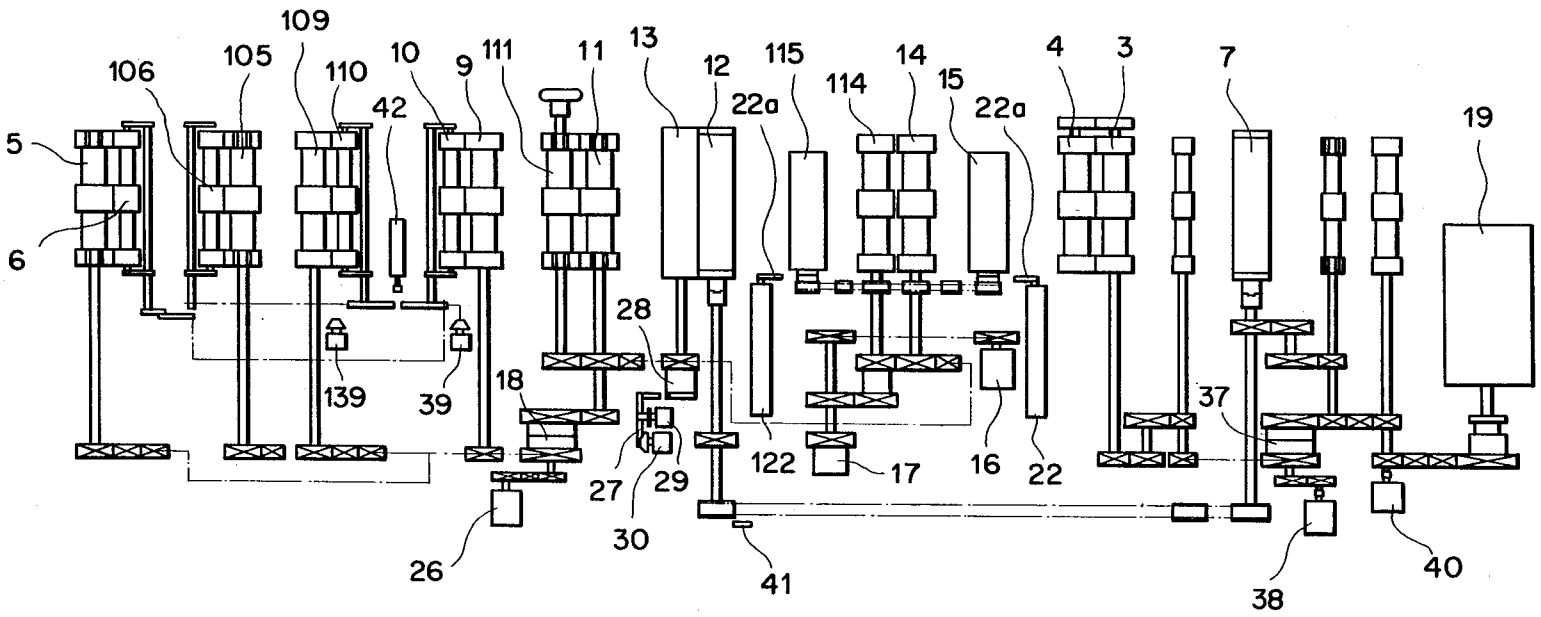

FIG. 1 is a schematic illustration of the whole of a wrapping material feed system equipped with an automatic wrapping material change-over apparatus according to the present invention, and FIG. 2 illustrates a power transfer route thereof.

In the figures, the reference numerals 1 and 101 denote bobbins and the numerals 2 and 102 denote wrapping materials with patterns thereon.

The wrapping materials 2 and 102 are given a delivery force by a feed roller 3 and a receiving roller 4 to be drawn out from the bobbins 1 and 101, then are guided to an automatic change-over apparatus embodying the invention by means of direction changing feed rollers 5, 105 and receiving rollers 6, 106, and after passing the change-over apparatus, those wrapping materials are cut into a predetermined size by a main knife roller 7 and a knife receiving roller 8, then pasted and conveyed to a wrapping step.

The automatic change-over apparatus of the present invention is composed of a first take-up roller device for taking up the wrapping material from the bobbin 1 (the first take-up roller device comprising a change-over feed roller 9, a receiving roller 10, a collection roller 11, a suction separation roller 14 and a take-up roller 15), a second take-up roller device for taking up the wrapping material from the bobbin 101 (the second take-up roller device comprising a change-over feed roller 109, a receiving roller 110, a collection roller 111, a suction separation roller 114 and a take-up roller 115), a drive device for driving the second-take-up roller device (the drive device comprising a motor 16, an electromagnetic clutch 17 and a differential gear 18), and a change-over knife device for cutting the wrapping materials 2 and 102 (the change-over knife device comprising a change-over knife roller 12 and a change-over knife receiving roller 13).

The change-over feed rollers 9, 109, receiving rollers 10, 110, collection rollers 11, 111, change-over knife roller 12, change-over knife receiving roller 13 and suction separation rollers 14, 114, which constitute the first and second take-up roller devices and the change-over knife device, are disposed along a Y-shaped passage.

Figure 3:
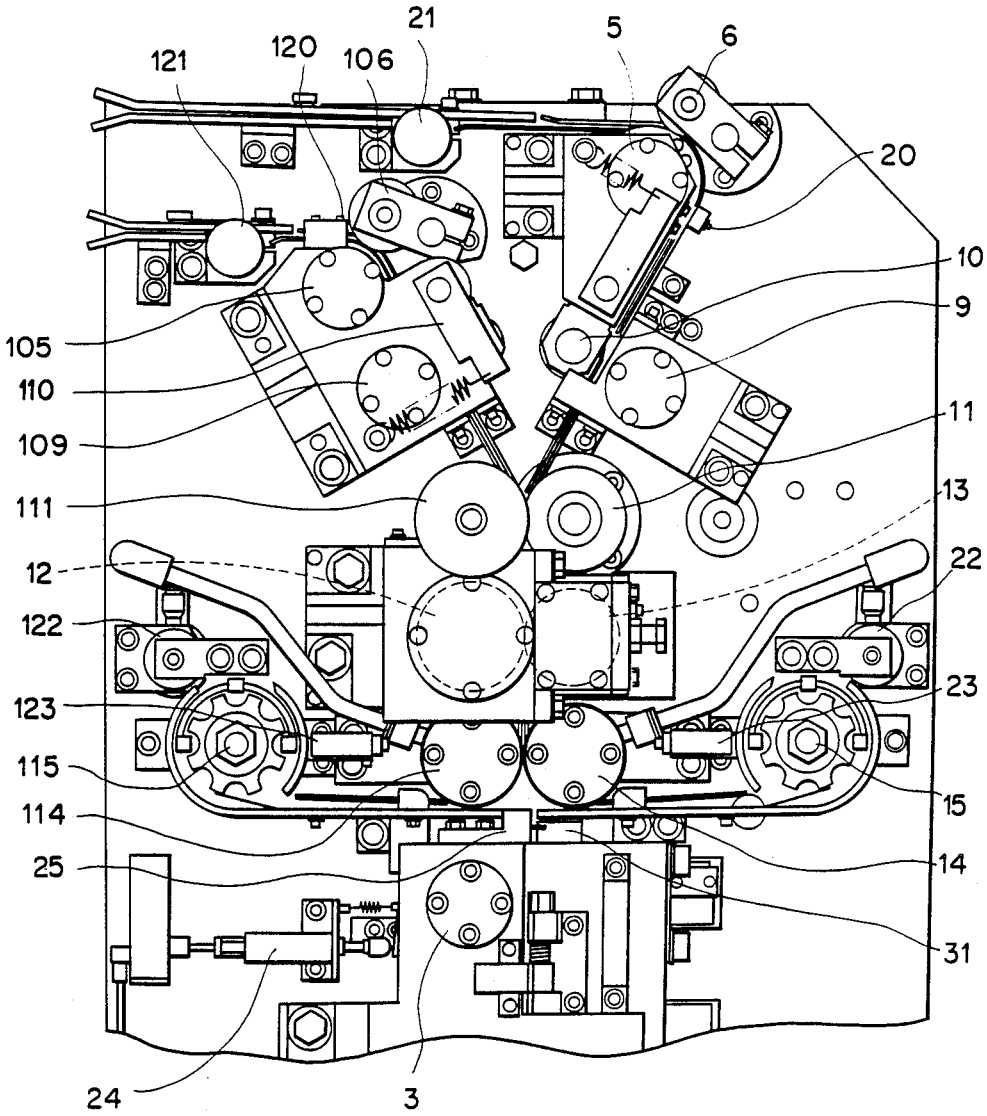

Referring now to FIG. 3, there is fully illustrated the automatic change-over apparatus of the present invention in which on an inlet side (upper position in FIG. 3) of the Y-shaped passage there are disposed register mark detectors 20 and 120 for detecting patterns affixed at predetermined intervals to the wrapping materials 2 and 102, as well as suction brakes 21 and 121, while in positions close to the take-up rollers 15 and 115 there are disposed air cylinders 22 and 122 for discharging front end portions of the wrapping materials 2 and 102.

The air cylinders 22 and 122 have discharge portions **22*a* and 122*a* provided at fore ends of the respective pistons, the discharge portions 22*a* and 122*a* being adapted to move along the peripheral surfaces of the take-up rollers 15 and 115 (axially of the rollers 15 and 115) to discharge the wound-up wrapping materials 2 and 102 from the peripheral surfaces of the take-up rollers 15 and 115, as shown in FIG. 2**.

Further, between the suction separation roller 14 and the take-up roller 15, and between the suction separation roller 114 and the take-up roller 115, there are disposed take-up confirmation detectors 23 and 123, respectively. Below the suction separation rollers 14 and 114 is provided a guide 25 which is moved up and down by a cylinder 24. The guide 25 moves down during preparation for change-over to permit the wrapping materials 2 and 102 to move toward the take-up rollers 15 and 115.

During preparation for change-over, the motor 16 as a constituent of the drive device causes the first take-up roller device (change-over feed roller 9, collection roller 11, suction separation roller 14 and take-up roller 15) or the second take-up roller device (change-over feed roller 109, collection roller 111, suction separation roller 114 and take-up roller 115) to rotate at a low speed. Further, during change-over operation, the electromagnetic clutch 17 transfers the rotation of a main motor 19 (see FIG. 2) to the first take-up roller device (change-over feed roller 9, collection roller 11, suction separation roller 14 and takeup roller 15) or to the second take-up roller device (changeover feed roller 109, collection roller 111, suction separation roller 114 and take-up roller 115). As the differential gear 18 there is used a harmonic differential unit. This harmonic differential unit is composed of a wave generator (comprising an elliptic cam and a ball bearing fitted over the outer periphery thereof), a flex-spline (a thin-walled cup-like metallic elastic body having an opening portion with involute teeth formed on the outer periphery thereof) and a circular spline (a ring-like rigid body provided on the inner periphery thereof with teeth of the same pitch as the flex-spline, the number of the teeth being larger by two than the teeth of the flex-spline).

The differential gear 18 increases or decreases the revolution of the change-over feed roller 9 or 109 without increasing the revolution of the motor 19 for registering pattern at the time of the change-over operation through a stepping motor 26 (see FIG. 2, the stepping motor 26 being controlled with signals provided from the register mark detectors 20 and 120) which is an adjusting motor for the differential gear.

A differential gear 37 on the side of the wrapping material feed system is also constituted by a harmonic differential unit, and by a stepping motor 38 (see FIG. 2, the stepping motor 39 being controlled with a signal provided from a register mark detector 31) which is an adjusting motor for the differential gear, the revolution of the feed roller 3 is increased or decreased without increasing or decreasing the revolution of the motor 19 for registering pattern during delivery of the wrapping materials.

The rotational shaft of the change-over knife receiving roller 13 as a constituent of the change-over knife device is eccentric and a short-diameter side thereof is normally opposed to the change-over knife roller 12. To the change-over knife receiving roller 13 is connected an SR clutch as shown in FIG. 2.

Figure 4:
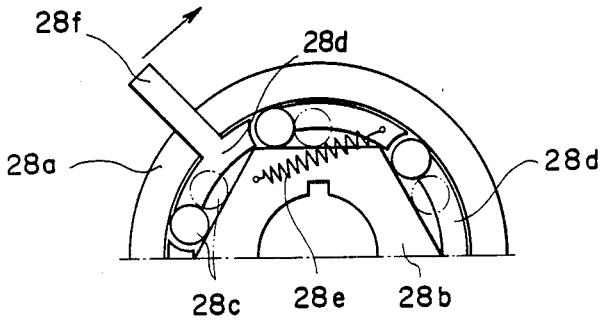
Figure 10:
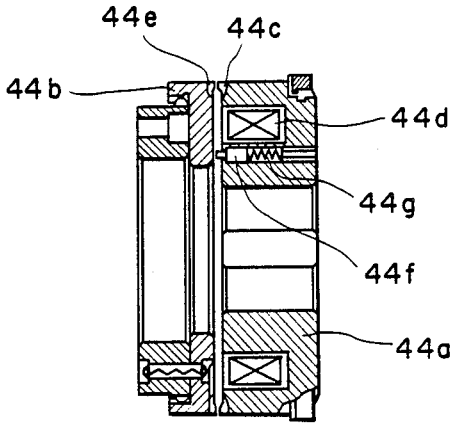
FIG. 10 is a sectional view of an electromagnetic single position clutch.

The SR clutch 28 is composed of an outer race **28*a* (connected to the drive system of the motor 16 on the drive side), an inner race 28*b* (connected to the change-over knife receiving roller 13 on the load side) and a roller 28*c* interposed between the outer and inner races 28*a* and 28*b*, as shown in FIG. 4. The roller 28*c* is held within a trip cam cage 28*d* and it is located in its solid line position (ON) in the same figure under the action of a coil spring 28*e*. When a step portion 28*f* of the trip cam cage 28*d* is pushed in the direction of arrow in FIG. 4 by a lever 27 (see FIGS. 2 and 4), the roller 28*c*** assumes the position (OFF) indicated by an alternate long and two short dashes line in the same figure.

Normally the lever 27 pushes the step portion **28*f* so that the SR clutch 28 is OFF (the roller 28*c* is in its alternate long and two short dashed line position), while when a solenoid 29 (see FIG. 2) is energized to disengage the lever 27 from the step portion, the SR clutch 28 turns ON (the roller 28*c* occupies its solid line position) and the rotation of the motor 16 is thereby transferred to the change-over knife receiving roller 13, so that the roller 13 rotates and its large diameter section becomes opposed to the change-over knife roller 12, whereby the wrapping materials 2 and 102 are pushed against the roller 12 and is cut thereby. Upon operation of a solenoid 30 the lever 27 comes into engagement with the step portion 28***f* and the SR clutch 28 turns OFF in a predetermined constant position.

Like the main knife roller 7, the change-over knife roller 12 is normally rotated by the motor 19.

In FIG. 1 the reference numerals 32 and 132 denote fore-end strippers; numerals 33 and 133 denotes preliminary suction rollers; numerals 34 and 134 denote tension rollers; numerals 35 and 135 denote preliminary feed rollers; and numeral 36 denotes a motor.

The operation of the above embodiment will be described below.

In normal condition, the rollers 9, 109, 10, 110, 11 and 111 of the automatic change-over device are all retreated and so gaps are formed between rollers. For example, where the wrapping material 2 is drawn out from the bobbin 1, the wrapping material 2 is driven a delivery force by the feed roller 3 driven by the motor 19 and the receiving roller 4 and it passes the preliminary suction roller 33, tension roller 34 and preliminary feed roller 35, it is changed in its direction by the direction changing feed roller 5 and thereafter passes the automatic change-over apparatus.

A one-way clutch is incorporated in each of the direction changing feed rollers 5 (105) and collection rollers 11 (111) to reduce the delivery resistance.

Whether or not there is feed lag of the wrapping material 2 is detected by the register mark detector 31 while the wrapping material passes the automatic change-over apparatus. In the event said feed lag is detected by the detector 31, the stepping motor 38 operates in accordance with a signal provided from the detector 31 such that the revolution of the feed roller 3 is increased or decreased by the differential gear 37 without increasing or decreasing the revolution of the motor 19, to correct the feed lag.

Thereafter, the wrapping material 2 is cut into predetermined size and pattern by the main knife roller 7 and knife receiving roller 8, then pasted by a paste roller 50 and a receiving roller 51 and thereafter sent to a wrapping machine.

Figure 5A:
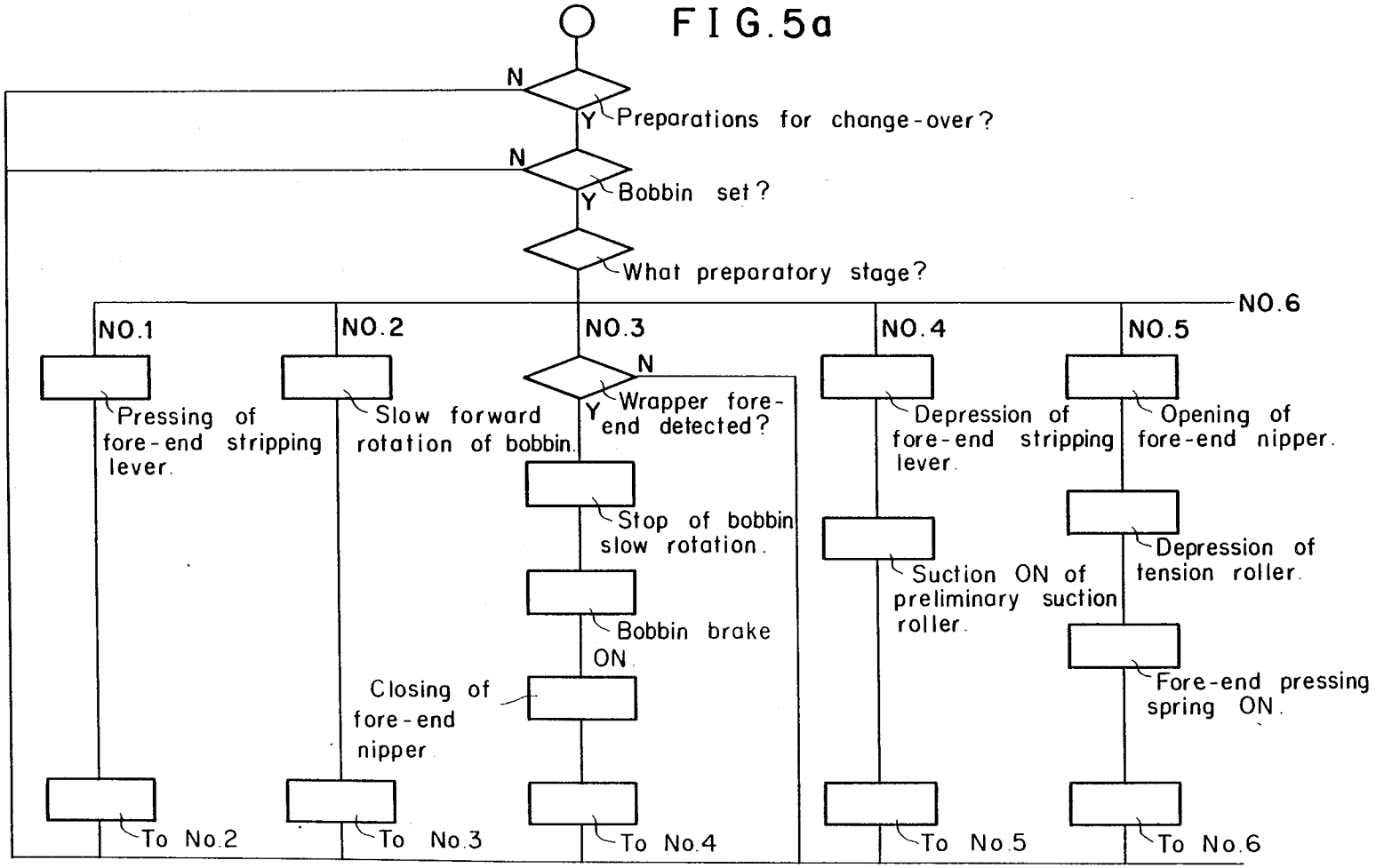
FIGS. 5*a* and 5*b* are each a flowchart showing a changeover preparation routine.
Figure 5B:
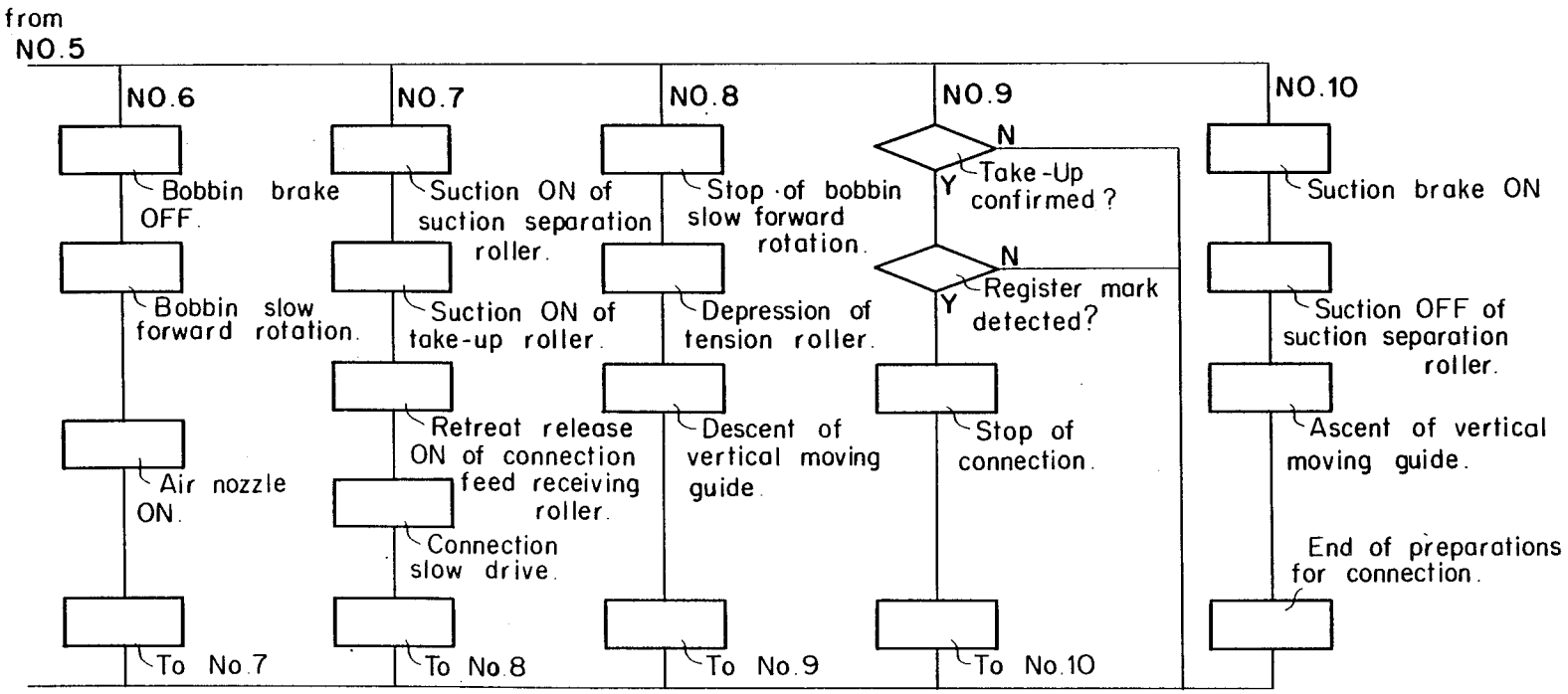

When the winding diameter of the wrapping materal 2 becomes smaller than a predetermined value (as the case may be there is made a voluntary change-over) after its delivery from the bobbin 1 as mentioned above, there are made preparations for change-over to the other bobbin 101. The preparations for change over are performed in accordance with the change-over preparation routines shown in FIGS. 5*a* and 5*b*.

First, the fore-end stripper 132 is pushed against the wrapping material 102 on the bobbin 101. Then, the bobbin 101 is rotated slowly by the motor 36. When a fore end portion of the wrapping material 102 is detected by a sensor (not shown) attached to the fore-end stripper 132, the rotation of the bobbin 101 stops. Then, a bobbin brake (not shwon) turns ON and a fore end nipper (not shown) of the fore-end stripper 132 closes to nip the fore end portion of the wrapping material 2. The fore-end stripper 132 is then forced down while nipping the fore end portion of the wrapping material 2 and goes away from the bobbin 101. Then, the preliminary suction roller 133 operates to suck the fore end portion of the wrapping material 102. Then, the fore end nipper of the fore-end stripper 132 opens and releases the fore end portion of the wrapping material 102. Thereafter, the tension roller 134 is forced down and the fore end portion of the wrapping material 102 is pushed against the preliminary suction roller 133 by means of a fore-end passing spring (not shown). Then, the bobbin brake is turned OFF and the bobbin 101 is rotated slowly by a motor 36.

When the wrapping material 102 is thus drawn out from the bobbin 101, the suction of the suction separation roller 114 and take-up roller 115 becomes ON and then the receiving roller 106 is released from its retreated state. Thereafter, the second take-up roller device (change-over feed roller 109, collection roller 111, suction separation roller 114 and take-up roller 115) is rotated slowly by the motor 16. The release of the retreated state of the solenoid 139 is effected by turning the solenoid 139 (see FIG. 2) from ON to OFF.

Then, the rotation of the motor 36 is stopped, the tension roller 134 is pushed up and the guide 25 is brought down by the cylinder 24. When it is detected by the take-up confirmation detector 123 that the take-up roller 115 has taken up the fore end portion of the wrapping material 102 and when pattern is detected by the register mark detector 120, the motor 16 stops rotation. Then, the suction brake 121 turns ON, the suction of the suction separation roller 114 turns OFF and the guide 25 is moved up by the cylinder 24.

Figure 6:
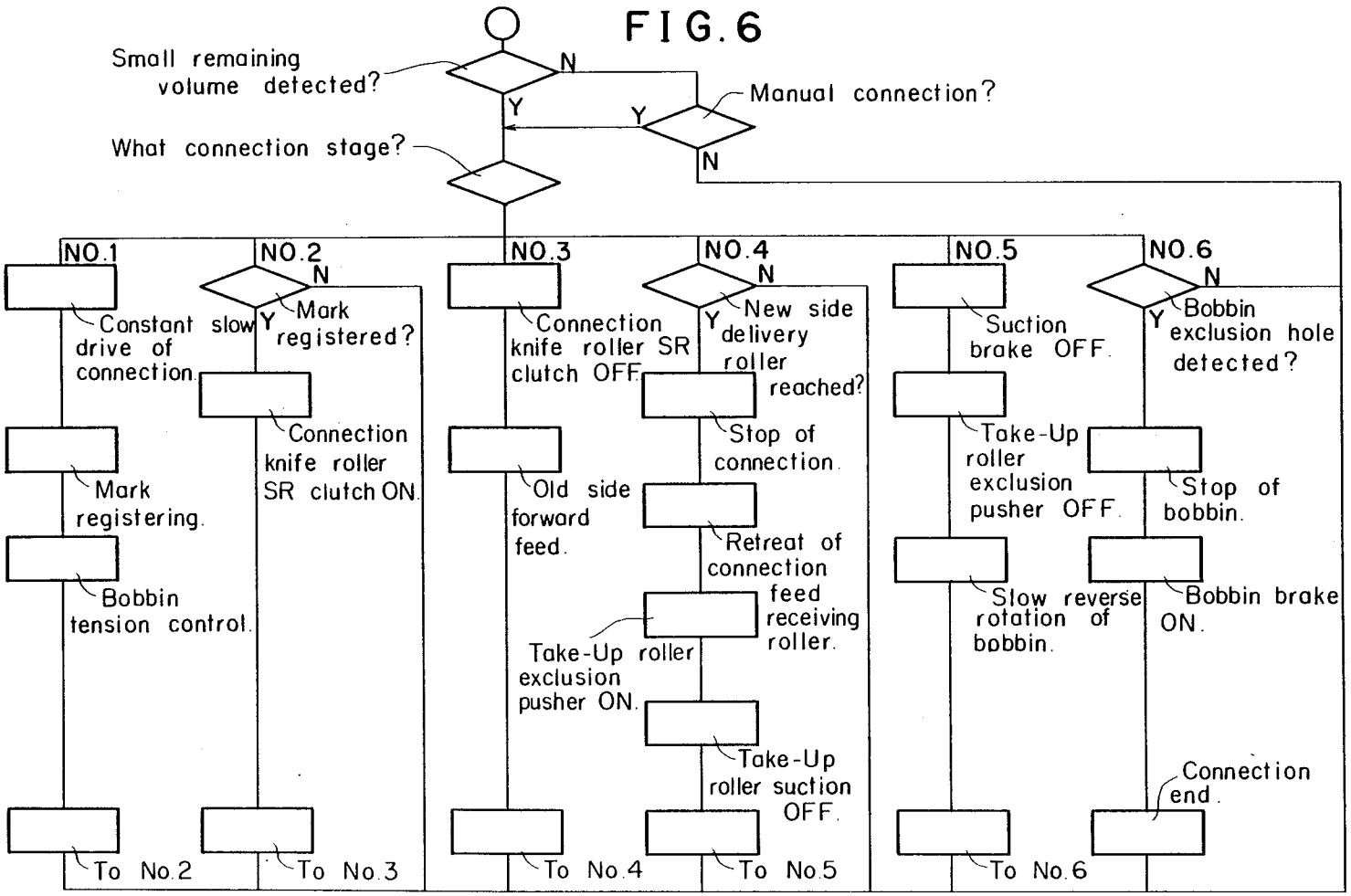

When the volume of the wrapping material 2 remaining on the bobbin 1 becomes small after the preparations for change-over are thus completed, there is performed a change-over operation in accordance with the change-over routine shown in FIG. 6.

First, the electromagnetic clutch 17 is turned ON to transfer the rotation of the motor 19 of the wrapping material feed system to the second take-up roller device to drive the latter at a constant speed, namely, at a speed ratio thereof to the wrapping material feed system of 1:1. Then, upon detection of the pattern by the register mark detector 120, there is made registering of pattern between the wrapping materials 102 and 2.

Figure 7:
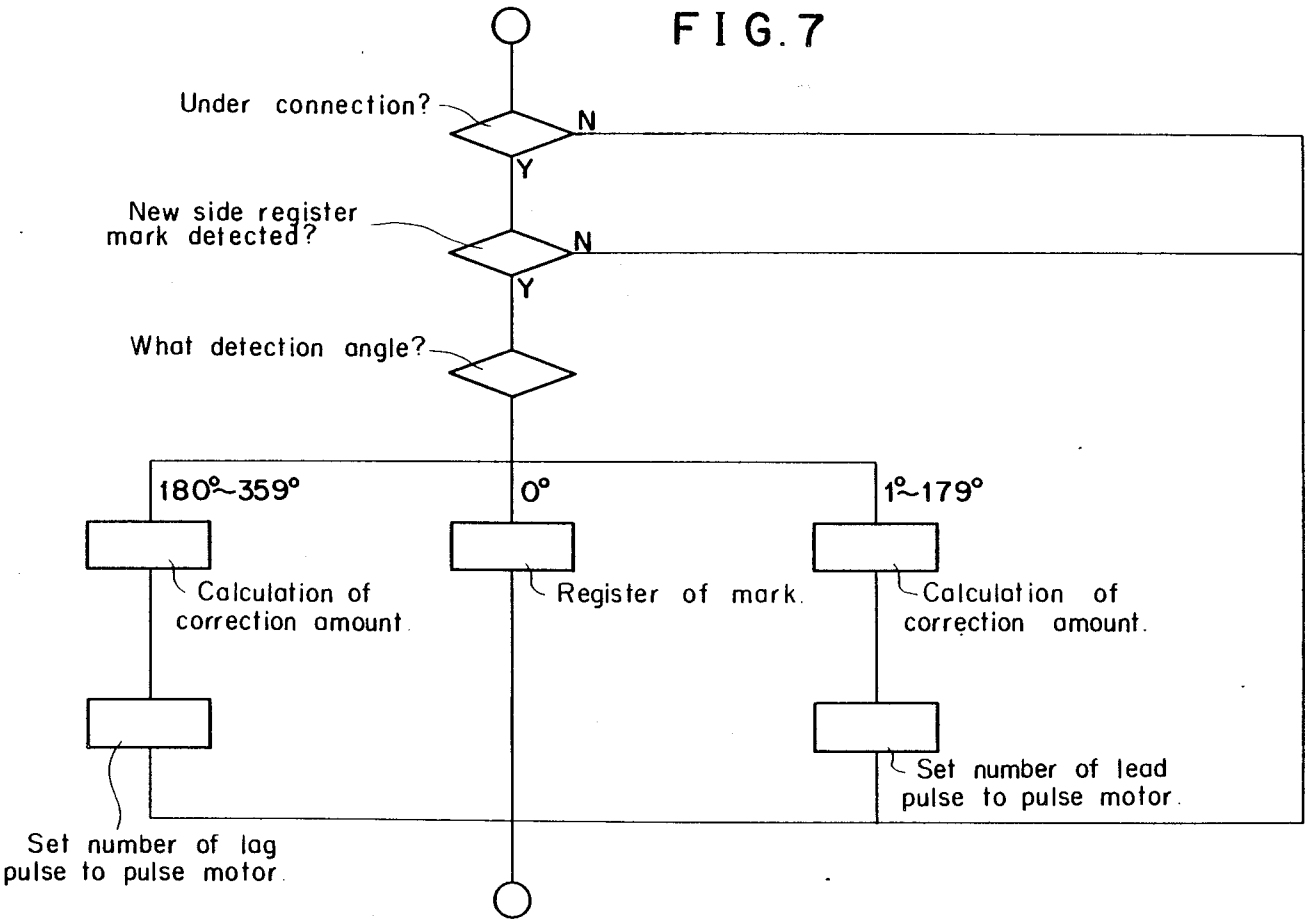

The registering of pattern is performed in accordance with the pattern registering routine shown in FIG. 7. First, a mechanical angle of the wrapping material feed system is detected by a rotary encoder 40 and an angle read port of a microcomputer (not shown) is latched upon detection of a register mark. Then, lag of pattern advance (register mark) is calculated from the latched angle and the number of pulses for correcting the said lag is determined. This number of pulses is provided to the stepping motor 26 in accordance with an up-down system to drive the motor. When the latched angle is in the range of 1° to 179°, a lead pulse is provided, while when the latched angle is in the range of 180° to 359°, a lag pulse is provided, whereby the differential gear 18 is operated to increase or decrease the revolution of the change-over feed roller 109. When the timing of a pulse signal from the register mark detector 20 or 120 and that of a pulse signal from the register mark detector 31 become coincident with each other, the register mark of the wrapping material 102 coincides with that of the wrapping material 2.

After the registering of pattern is completed, an edge position of the change-over knife roller 12 is detected by a photo switch 41 and the SR clutch 28 is turned ON by the solenoid 29, whereupon the change-over knife receiving roller 13 rotates and pushes the wrapping materials 102 and 2 against the change-over knife roller 12 to cut the wrapping materials 102 and 2 at a time to produce a free wrapping material cut off from the wrapping material 2 and a discard leading portion from the wrapping material 102. The SR clutch 28 is then turned OFF by the solenoid 30. Thereafter, when the cut portions approach the main knife roller 7, the revolution of the main feed roller 3 is increased by the differential gear 37 to advance the wrapping material 2 so that a gap of about 0.8 mm is formed between the rear end of the wrapping material 2 and the fore end of the wrapping material 102 and the main knife roller 7 acts in the gap between the the cut ends.

That the mechanical revolution of the wrapping material feed system has reached a predetermined number (i.e. three revolutions) is detected after the cutting with a signal provided from the rotary encoder 40, the electromagnetic clutch 17 is turned OFF, an air cylinder 42 is turned from ON to OFF to retreat the receiving rollers 110 and 106, and the guide 25 is brought down by the cylinder 24. Then, the discard leading portion of the wound-up wrapping material 102 is discharged from the take-up roller 115 by means of the air cylinder 122, then the suction brake 21 is turned OFF and the bobbin 1 is reverse-rotated slowly to recover the remaining piece of the wrapping material 2.

Switching from the bobbin 101 to the bobbin 1 is also performed in the same manner. When the registering of pattern is not needed, the pattern registering routine shown in FIG. 7 is omitted.

According to the above embodiment, the main knife roller 7 and the change-over knife roller 12 are normally rotated by the motor 19 always under the same timing. During the change-over operation, therefore, the wrapping materials 2 and 102 can be cut by the change-over knife roller 12 at the same timing as the main knife roller 7.

During the change-over operation, moreover, the wrapping material 102 is held under tension while moving at the same speed as the wrapping material 2, so there is no fear of an error (such as feed lag) caused by loosening of the wrapping material 102.

Further, since the change-over knife receiving roller 13 is an eccentric roller and it is rotated by the SR clutch 28, it can be stopped positively with its short diameter side opposed to the change-over knife roller 12. Moreover, since the half of the change-over knife receiving roller 13 is a large diameter section 25*a*, the cutting can be done during 180° rotation of the roller 13 and consequently it is possible to take margin for adjustment of the change-over timing.

Additionally, in the portion where cutting is to be done by the change-over knife roller 12 there is formed a gap of about 0.8 mm by the feed roller 3, so there is no fear of a short piece being produced by twice cutting with the main knife roller 7.

Further, during preparations for change-over, the guide 25 is brought down to create a large gap between the guide 25 and the suction separation roller 114 (14), so it becomes easier for the wrapping material 102 (2) to be delivered toward the take-up roller 115 (15). Besides, during the change-over operation the guide 25 is moved up to minimize the gap, so it is not possible that the fore end of the wrapping material 102 (2) which has been cut by the changeover knife roller 12 will be engaged with the suction separation roller 114 (14).

Figure 8:
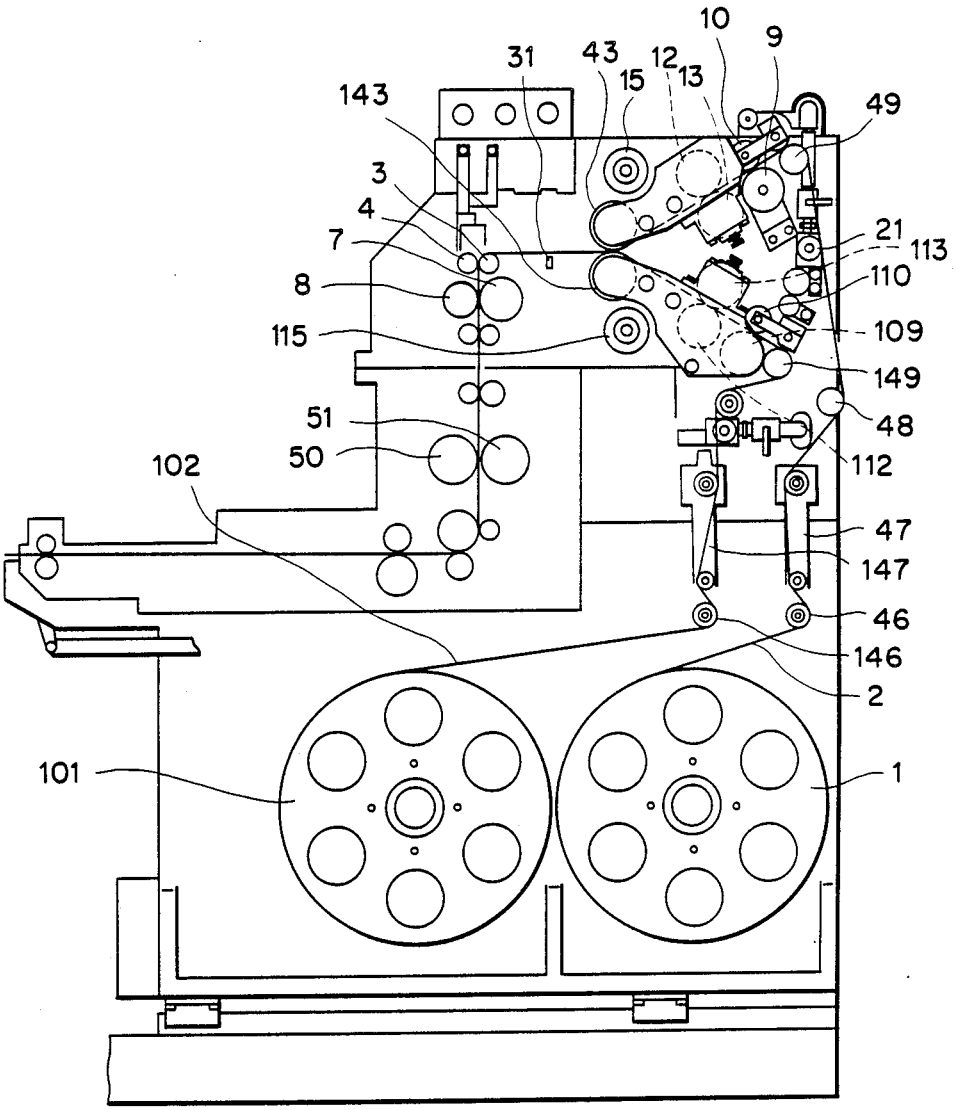
Figure 9:
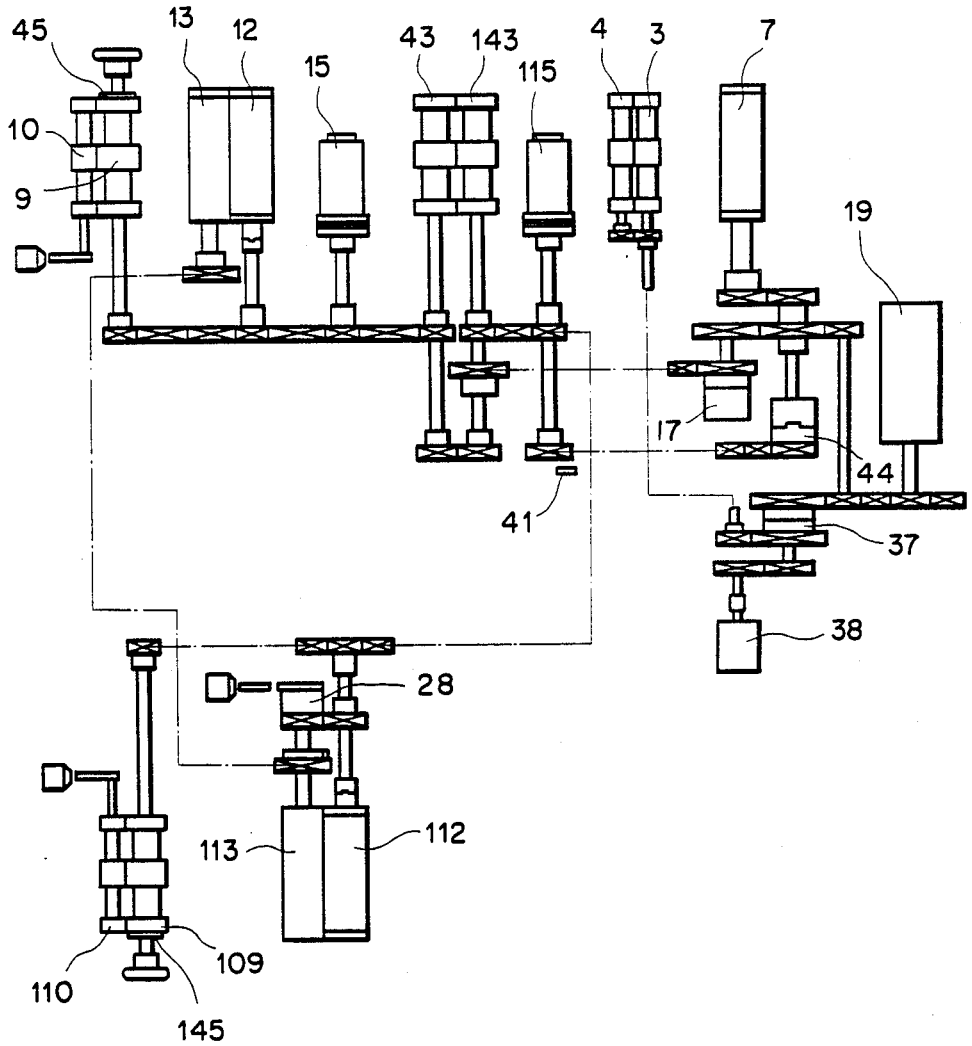

Referring now to FIGS. 8 and 9, there is illustrated a second embodiment of the present invention, in which the change-over preparing operation is performed manually and not automatically as in the above embodiment. In these figures the same constructional portions as in FIGS. 1 to 3 are indicated by the same reference numerals and explanations on their details will be omitted.

In this embodiment, since the change-over preparing operations is performed manually, there are provided guide rollers 43 and 143 in place of the suction separation rollers 14 and 114.

Moreover, there are provided two sets of change-over knife devices (change-over knife rollers 12, 112, change-over knife receiving rollers 13, 113) and at the time of switching operation the change-over knife receiving rollers 13 and 113 are rotated simultaneously by an SR clutch 28.

As a drive device, an electromagnetic single position clutch 44 is provided in addition to an electromagnetic clutch 17. When the clutch 17 is turned ON, the rotation of the motor 19 is transferred to a first take-up roller device (change-over feed roller 9, guide roller 43, take-up roller 15) or a second take-up roller device (change-over feed roller 109, guide roller 143, take-up roller 115), where the first or second take-up roller device begins to rotate as a speed ratio thereof to the wrapping material feed system of 1:0.957. At this time, the electromagnetic single position clutch 44 is energized. The clutch 44 is composed of a magnet body portion 44*a* (which incorporates therein a coil 44*d*) having teeth 44*c* formed on a side face thereof and an armature portion 44*b* having teeth 44*a* adapted to engage the teeth 44*c*. When the coil 44 is energized, the armature portion 44*b* is attracted by the magnet body portion 44*a* against a release plunger 44*f* and a coil spring 44*g*, and when mechanical revolutions of the wrapping material feed system become twenty-four at the most, the teeth 44*c* and 44*e* come into mesh with each other to turn ON the clutch.

Upon turning ON of the clutch, the foregoing speed ratio changes from 1:0.957 to 1:1. This is for the following reason. The first or second take-up roller device which is off cannot immediately operate at a speed ratio of 1:1 at the same timing as the wrapping material feed system, that is, there occurs a slight delay, so the electromagnetic single position clutch 44 is used to take a complete timing and the electromagnetic clutch 17 is used for auxiliary rotation.

Further, slits (not shown) for register of marks are formed in flanges 45 and 145 (see FIG. 8) of the change-over feed rollers 9 and 109. If the wrapping materials 2 and 102 are wound onto the take-up rollers 15 and 115 while conforming marks to those slits, the cutting portion at the change-over knife rollers 12 and 112 will become coincident with that at the main knife roller 7.

The operation of the above second embodiment will be described below.

In normal condition, for example where the wrapping material 2 is drawn out from the bobbin 1, it is given a delivery force by a feed roller 3 and a receiving roller 4. With this delivery force, the wrapping material 2 passes a guide roller 46, tension roller 47, guide rollers 48, 49, then passes the first take-up roller device and reaches a register mark detector 31, and possible feed lag of the wrapping material 2 having a register mark is detected by the register mark detector 31. In the event the lag of the register mark is detected, the revolution of the feed roller 3 is increased or decreased by a differential gear 37 to correct the mark shear. Thereafter, the wrapping material 2 is cut into predetermined size and pattern by means of a main knife roller 7 and a knife receiving roller 8, then pasted by a paste roller 50 and a receiving roller 51 and threafter sent to a wrapping machine.

When the winding diameter of the wrapping material 2 becomes smaller than a predetermined value (as the case may be there is made change-over before reaching the predetermined value, the discard leading end of the wrapping material 102 on the bobbin 101 is drawn out manually and is passed around a guide roller 146, tension roller 147 and guide roller 149. Then, it is passed between the change-over feed roller 109 and the receiving roller 110, between the change-over knife roller 112 and the change-over knife receiving roller 113 and further between the guide rollers 43 and 143, and is wound onto a take-up roller 115 (set to the second take-up roller device). At this time, the fore end of the register mark of the wrapping material 102 is conformed to the slit of the flange 145.

The above change-over preparing operation is performed manually, but the following switching operation is conducted automatically like the previous embodiment. The electromagnetic clutch 17 turns ON when the residual volume of the wrapping material 2 becomes small, and the second take-up roller device begins to rotate at a speed ratio thereof to the wrapping material feed system of 1:0.957, which speed ratio changes to 1:1 upon turning ON of the electromagnetic single position clutch 44. Then, whether the change-over knife rollers 12 and 112 are in positions capable of being switched over or not is detected by a photo switch 41. Then, the SR clutch 28 operates and the change-over knife receiving rollers 13 and 113 rotate at a time to push the wrapping materials 2 and 102 against the change-over knife rollers 12 and 112 to cut them simultaneously.

Thereafter, the bobbin 1 is stopped by a bobbin brake. And when the portion (rear end) of the wrapping material 2 cut by the change-over knife roller 12 approaches the main knife roller 7, the revolution of the main feed roller 3 is increased by the differential gear 37 to advance the wrapping material 2 thereby creating a gap of about 0.8 mm between the rear end of the wrapping material 2 and the fore end of the wrapping material 102.

When mechanical revolutions of the wrapping material feed system become four after cutting with the change-over knife rollers 12 and 112, the electromagnetic single position clutch 44 is turned OFF.

Switching from the bobbin 101 to the bobbin 1 is also performed in the same manner.

A third embodiment of the present invention will be described below.

Figure 11A:
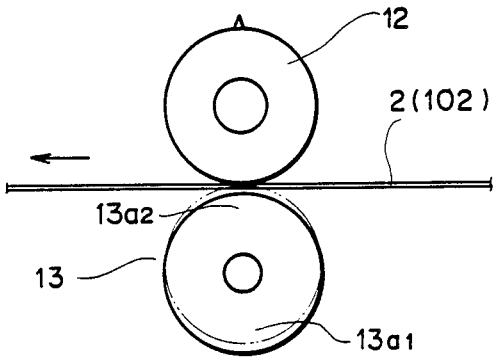
FIG. 11*a* is a schematic side view showing an example of a cutting device according to the present invention and FIG. 11*b* is a partially omitted front view thereof.
Figure 11B:
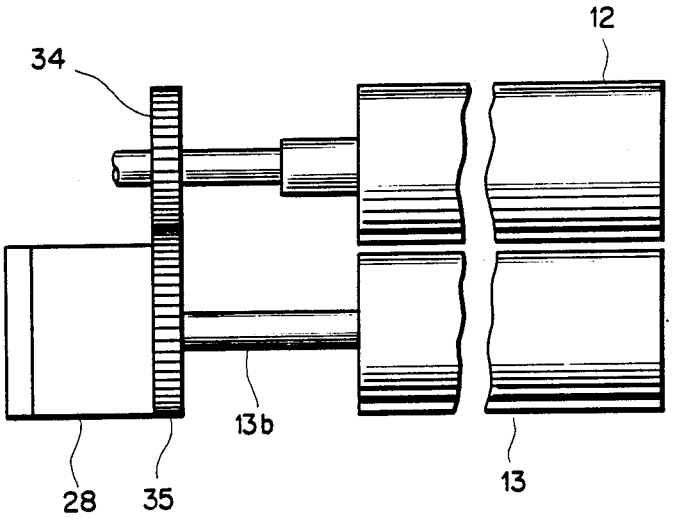
Figure 12A:
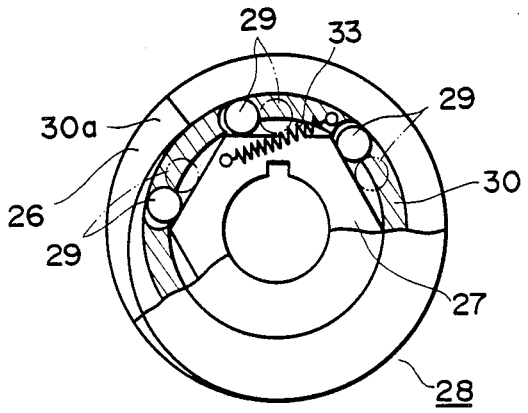
FIG. 12*a* is a partial cut-away side view of the clutch mechanism (SR clutch 28)
Figure 12B:
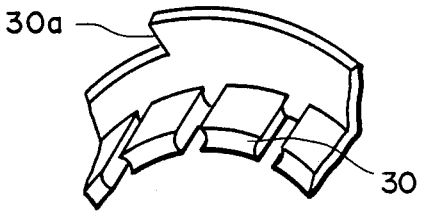
FIG. 12*b* is a partial perspective view of a trip cam cage which constitutes the clutch mechanism.
Figure 12C:
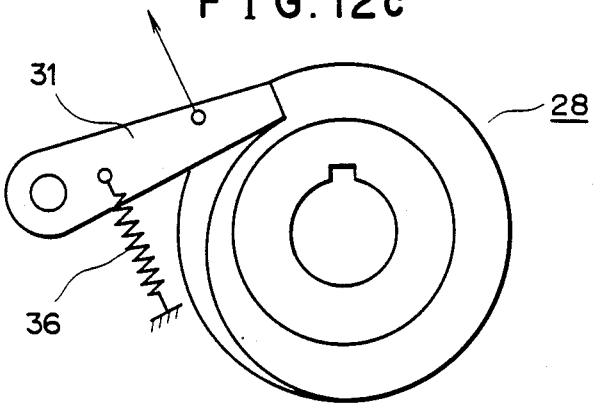
FIG. 12*c* is an explanatory view showing a relation between the trip cam cage and a lever.

FIG. 11*a* is a schematic side view showing an example of a cutting device which serves as the change-over knife used in the system of FIGS. 8 and 9; FIG. 11*b* is a partially omitted front view thereof; FIG. 12*a* is a partially cutaway side view of a clutch mechanism (SR cluch 28); FIG. 12*b* is a partial perspective view of a trip cam cage which constitutes the clutch mechanism; and FIG. 12*c* is an explanatory view showing a relation between the trip cam cage and a lever.

This change-over knife comprises change-over knife rollers 12, 112 and change-over knife receiving rollers 13, 113, which are disposed between change-over feed roller 9, receiving roller 10 and guide roller 43 and between change-over feed roller 109, receiving roller 110 and guide roller 143.

FIGS. 11*a* and *b* show in detail the change-over knife roller 12 and the change-over knife receiving roller 13. The change-over knife roller 12 is rotated by the main motor 19 at the time of change-over. The change-over knife receiving roller 13 has an eccentric shaft (constituting an eccentric roller) and it is divided into a long-diameter portion 13*a* and a short-diameter portion 13*b*. Normally the small diameter section $13a_2$ is positioned on the side of the change-over knife roller 12, and at the time of cutting operation the large diameter section $13a_1$ is positioned on the side of the change-over knife roller 12 as indicated by an alternate long and two short dashes line in FIG. 11*a*. SR clutch 28 is connected to the change-over knife receiving roller 13.

As shown in FIGS. 12*a*, *b* and *c*, the SR clutch 28 is composed of an outer race 26 (connected to the main motor 19 through engagement of teeth 34 and 35 shown in FIG. 11*b* on the drive side), an inner race 27 (connected to a rotational shaft 13*b* of the change-over knife receiving roller 13 shown in FIG. 11*b* on the load side) and a roller 29 disposed between the outer and inner races 26 and 27. The roller 29, which is held within a trip cam cage 30, assumes an alternate long and two short dashes line position (clutch-off state) shown in FIG. 12*a* when a lever 31 is in engagement with a step portion 30*a* of the trip cam cage 30, and occupies it position (clutch-on state) indicated by a solid line in FIG. 12*a* under the action of a coil spring 33 when the lever 31 is disengaged from the step portion 30*a* by means of the solenoid (see FIG. 9).

The SR clutch 28 is normally kept off by engagement of the lever 31 with the step portion 30*a* under the action of a coil spring 36, and it turns ON when the solenoid 32 operates and the lever 31 is thereby disengaged from the step portion 30*a*, so that the outer and inner races 26 and 27 come into engagement with each other to transfer the rotation of the main motor 19 to the change-over knife receiving roller 13. When both races turn fully once in this state, that is, when they return to their original positions, the lever 31 is brought into engagement with the step portion 30*a* by the coil spring 36 to turn off the clutch.

At the time of change-over performed by the SR clutch 28 a large diameter section $13a_1$ of the change-over knife receiving roller 13 rotates toward the change-over knife receiving roller 12. In this case, there is a margin for adjustment of the change-over timing because about half of the roller 13 constitutes the large diameter section $13a_1$. Upon one rotation the SR clutch 28 turns OFF and stops in a predetermined constant position. In other words when the SR clutch turns ON at a time of change-over, it rotates from that position. Therefore, it is possible to conform timing to the cutting operation of the main knife roller 7 easily.

Explanation on the change-over knife roller 112 and change-over knife receiving roller 113 is here omitted because they are of the same construction as above.

Slits (not shown for register of pattern are formed in the flanges 45 and 145 (see FIG. 9) of the change-over feed rollers 9 and 109. If the wrapping materials 2 and 102 are wound up onto the take-up rollers 15 and 115 while conforming register marks to those slits, the cut portion at the change-over knife rollers 12 and 112 will come to coincide with the cut portion at the main knife roller 7.

Although in the above embodiment the cutting device of the above construction was applied to the automatic wrapping material change-over apparatus in the wrapping material feed system, this does not constitute any limitation, that is, the cutting device is applicable widely to any case where it is required to perform a cutting operation while taking timing with another member.

According to one embodiment of the present invention as set forth hereinabove, the automatic wrapping material change-over apparatus includes take-up roller devices (first and second take-up roller devices) for taking up a wrapping material from another bobbin and rotating the latter during change-over operation, and a change-over knife device for simultaneously cutting the wrapping material from the another bobbin and that from one bobbin which are being moved and drawn out respectively by the take-up roller devices, in which the thus-cut end of the wrapping material from the another bobbin follows the thus-cut end of the wrapping material from the one bobbin both at the same speed. Because of such a construction there is no fear of timing error during the change-over operation.

Further, the automatic wrapping material change-over apparatus according to another embodiment of the invention includes take-up roller devices (first and second take-up roller devices) for taking up a wrapping material from another bobbin and rotating the latter during change-over operation, a mark detector (register mark detector 20) for detecting a mark affixed to the wrapping material on one bobbin, a mark detector (register mark detector 120) for detecting a mark affixed to the wrapping material on the another bobbin, and a change-over knife device for simultaneously cutting the wrapping material from the another bobbin and that from the one bobbin which are being moved and drawn out respectively by the take-up roller devices upon detection of a register of marks between the wrapping materials from the one and the another bobbin, in which the thus-cut end of the wrapping material from the another bobbin follows the thus-cut end of the wrapping material from the one bobbin. Because of such a construction, even if this cutting device is applied to a wrapping material feed system which cuts patterned wrapping materials into a predetermined size while registering the patterns and then supplies them to a wrapping step, it is not likely that the feed lag of the pattern will occur during change-over operation.

Further, the knife receiving roller is made eccentric and between it and its drive mechanism (main motor 19) there is disposed a clutch mechanism (SR clutch 28) which connects the knife receiving roller to the drive mechanism so that the large diameter section of the knife receiving roller rotates to the knife roller side at the time of cutting operation and which cuts off the connection of the two so that the knife receiving roller stops rotation in a predetermined constant position at the end of the cutting operation. Therefore, at the start of cutting the knife receiving roller rotates always from the predetermined constant position, and there is a margin for adjustment of the cutting timing because about half of the knife receiving roller constitutes the large diameter section. Consequently, it is possible to effect the cutting operation easily while taking timing with another member.

What is claimed is:

1. An automatic wrapping material change-over apparatus comprising first and second bobbins wound respectively with first and second wrapping materials, and means for mounting said first and second bobbins arranged opposite each other;

feed roller means for drawing out said first wrapping material from the first bobbin;

first and second take-up roller means provided between said first and second bobbins and said feed roller means symmetrically with respect to the drawn out first wrapping material, said second wrapping material being adapted to be taken up onto the second take-up roller means; and change-over knife means provided upstream of each of said first and second take-up roller means at a predetermined distance therefrom for simultaneously cutting said first and second wrapping materials generally along a single line extending generally perpendicular to the direction of travel of said first and second materials to produce a free wrapping material cut off from said first wrapping material and a discard leading portion from said second wrapping material taken up on the take-up roller means, a fresh cut leading end of the second wrapping material thereby closely following a fresh cut trailing end of the first wrapping material.

2. An automatic wrapping material change-over apparatus according to claim 2, wherein said first and second bobbins are arranged axially parallel.

3. An automatic wrapping material change-over apparatus according to claim 1, further including wrapping material collection roller means between said first and second bobbins and said change-over knife means to define a common cutting region between said first and second bobbins and said first and second take-up roller means.

4. An automatic wrapping material change-over apparatus according to claim 3, further including means for drawing out and taking up the second wrapping material onto the second take-up roller means.

5. An automatic wrapping material change-over apparatus according to claim 3, wherein said change-over knife means includes a knife roller provided on a first side of said common cutting region and a change-over knife receiving roller provided on a second side of said common cutting region.

6. An automatic wrapping material change-over apparatus according to claim 5, further including main cutter means provided downstream of feed roller means, a feed lag detector provided upstream of said main cutter means to generate a signal upon detection of feed lag of each fed wrapping material, and control means for controlling the feed roller such that said each fed wrapping material is cut by said main cutting means at predetermined points.

7. The apparatus of claim 1, further including means for automatically threading a fresh supply of one of said first and second wrapping materials from one of said first and second bobbins onto the first and second take-up roller means.

8. An automatic wrapping material change-over apparatus according to claim 3, wherein said first and second wrapping materials have predetermined patterns thereon, said apparatus further including a first register mark detector to detect the pattern on the first wrapping material, a second register mark detector to detect the pattern on the second wrapping material, an acceleration deceleration mechanism to change moving speeds of the second take-up roller means, control means to drive the change-over knife mechanism in response to signals from the first and the second register mark detectors transmitted when patterns of the first and second wrapping materials are detected to be in register.

9. An automatic wrapping material change-over apparatus according to claim 3, further including main cutter means provided downstream of feed roller means, a feed lag detector provided upstream of said main cutter means to generate a signal upon detection of feed lag of each fed wrapping material, and control means for controlling the feed roller such that said each fed wrapping material is cut by said main cutting means at predetermined points.

10. An automatic wrapping material change-over apparatus according to claim 9, further including means for accelerating the feed roller means to produce a slight gap upstream of said main cutter means between a trailing end of the free wrapping material and a leading end of the second wrapping material.

11. An automatic wrapping material change-over apparatus according to claim 1, further including means for rewinding said first wrapping material onto the first bobbin and means for discharging said discard leading portion of the second wrapping material from said second take-up roller means.

12. A wrapping material change-over apparatus, comprising:

first and second bobbins wound respectively with first and second wrapping materials, and means for mounting said first and second bobbins arranged opposite each other;

feed roller means for drawing out said first wrapping material from the first bobbin;

first and second take-up roller means provided between said first and second bobbins an said feed roller means symmetrically with respect to the drawn out first wrapping material, said second wrapping material being adapted to be taken up onto the second take-up roller means; and change-over knife means provided upstream of each of said first and second take-up roller means, said change-over knife means establishing a first cutting region defined between the said first bobbin and said first take-up roller means and a second cutting region defined between said second bobbin and said second take-up roller means, wherein said first wrapping material traveling through the first cutting region and said second wrapping material traveling through said second cutting region are respectively cut by the change-over knife means within said first and second cutting regions; and control means for positioning a fresh cut leading end of the second wrapping material cut within the second cutting region so as to closely follow a fresh cut trailing end of the first wrapping material cut within the first cutting region.

13. The apparatus of claim 12, further including means for manual threading a fresh supply of one of said first and second wrapping materials from one to said first and second bobbins onto the first and second take-up roller means.

14. An automatic wrapping material change-over apparatus according to claim 12, wherein said change-over knife means includes a first knife roller provided on a first side of the first cutting region, a first knife receiving roller provided on a second side of said first cutting region, a second knife roller provided on a first side of said second cutting region, and a second knife receiving roller provided on a second side of the second cutting region.

15. An automatic wrapping material change-over apparatus according to claim 14, wherein each of said first and second knife receiving rollers includes an eccentric roller having a large diameter section and a small diameter section, said eccentric roller being driven by a drive mechanism.

16. An automatic wrapping material change-over apparatus according to claim 15, further including clutch means provided between said eccentric roller and said drive mechanism for connection thereof at the time of switch-over cutting to cause said eccentric roller to rotate such that said large diameter section faces the knife roller and for disconnection after the switch-over cutting, said clutch means having a return spring therein to rotate the eccentric roller such that said small diameter section faces the knife roller at the time of disconnection.

* * * * *